US011446787B2

(12) United States Patent
Zhang et al.

(10) Patent No.: US 11,446,787 B2
(45) Date of Patent: Sep. 20, 2022

(54) OPEN COAT ABRASIVE ARTICLE AND METHOD OF ABRADING

(71) Applicant: 3M INNOVATIVE PROPERTIES COMPANY, St. Paul, MN (US)

(72) Inventors: Jing Zhang, Minneapolis, MN (US); Michael D. Kariniemi, Hamel, MN (US); Gregory S. Mueller, Eden Prairie, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 459 days.

(21) Appl. No.: 16/331,263

(22) PCT Filed: Sep. 21, 2017

(86) PCT No.: PCT/US2017/052618

§ 371 (c)(1),
(2) Date: Mar. 7, 2019

(87) PCT Pub. No.: WO2018/063902

PCT Pub. Date: Apr. 5, 2018

(65) Prior Publication Data

US 2019/0217444 A1 Jul. 18, 2019

Related U.S. Application Data

(60) Provisional application No. 62/400,316, filed on Sep. 27, 2016.

(51) Int. Cl.
*B24D 11/02* (2006.01)
*B24D 3/28* (2006.01)
(Continued)

(52) U.S. Cl.
CPC ..... *B24D 3/28* (2013.01); *B24D 11/02* (2013.01); *B24D 11/001* (2013.01); *B24D 18/0072* (2013.01); *B24D 2203/00* (2013.01)

(58) Field of Classification Search
CPC ..... B24D 3/28; B24D 3/24; B24D 11/001; B24D 11/02; B24D 18/0072; B24D 2203/00
(Continued)

(56) References Cited

U.S. PATENT DOCUMENTS 4,314,827 A 2/1982 Leitheiser et al.
4,588,419 A * 5/1986 Caul ..... B24D 3/002 427/501
(Continued)

FOREIGN PATENT DOCUMENTS

CN 1229376 9/1999
WO WO 2010/077519 7/2010

OTHER PUBLICATIONS

International Search report for PCT International Application No. PCT/US2017/052618 dated Jan. 8, 2018, 3 pages.

*Primary Examiner* — Joseph J Hail
*Assistant Examiner* — Arman Milanian

(57) ABSTRACT

An open coat abrasive article includes a backing having first and second opposed major surfaces, a make coat resin on at least one major surface of the backing, abrasive particles arranged on the backing at least partially embedded in the make coat resin, and a size coat resin on the first resin and the abrasive particles, wherein the shaped abrasive particles have an average peak count of no greater than about 40,000 per 24 $in^2$. A method of abrading in a body-in-white application is also disclosed.

18 Claims, 3 Drawing Sheets

(51) Int. Cl.
*B24D 11/00* (2006.01)
*B24D 18/00* (2006.01)

(58) Field of Classification Search
USPC ..... 45/28, 288
See application file for complete search history.

(56) References Cited

U.S. PATENT DOCUMENTS 4,623,364 A 11/1986 Cottringer et al.
4,652,274 A 3/1987 Boettcher et al.
4,652,275 A 3/1987 Bloecher et al.
4,744,802 A 5/1988 Schwabel
4,751,138 A 6/1988 Tumey et al.
4,770,671 A 9/1988 Monroe et al.
4,799,939 A 1/1989 Bloecher et al.
4,848,041 A 7/1989 Kruschke
4,881,951 A 11/1989 Wood et al.
4,903,440 A 2/1990 Larson et al.
4,985,340 A 1/1991 Palazzotto et al.
5,078,753 A * 1/1992 Broberg ..... B24D 3/28 51/298
5,086,086 A 2/1992 Brown-Wensley et al.
5,152,917 A 10/1992 Pieper et al.
5,201,916 A 4/1993 Berg et al.
5,213,591 A 5/1993 Celikkaya et al.
5,215,552 A 6/1993 Sung
5,236,472 A 8/1993 Kirk et al.
5,376,428 A 12/1994 Palazzotto et al.
5,385,954 A 1/1995 Palazzotto et al.
5,435,816 A 7/1995 Spurgeon et al.
5,436,063 A * 7/1995 Follett ..... C08L 63/00 428/326
5,672,097 A 9/1997 Hoopman
5,820,450 A * 10/1998 Calhoun ..... B24D 11/005 451/530
5,830,248 A 11/1998 Christianson et al.
5,946,991 A 9/1999 Hoopman
5,975,987 A 11/1999 Hoopman et al.
6,129,541 A 10/2000 Takeda
8,034,137 B2 10/2011 Erickson et al.
8,142,531 B2 3/2012 Adefris et al.
8,142,532 B2 3/2012 Erickson et al.
8,142,891 B2 3/2012 Culler et al.
8,361,176 B2 1/2013 Seth et al.
2008/0311826 A1* 12/2008 Thysell ..... B24B 7/186 451/41
2009/0165394 A1 7/2009 Culler et al.
2009/0169816 A1 7/2009 Erickson et al.
2010/0319269 A1* 12/2010 Erickson ..... C04B 35/62815 428/402
2012/0000135 A1 1/2012 Eilers et al.
2012/0227333 A1 9/2012 Adefris et al.
2012/0231711 A1 9/2012 Keipert et al.
2013/0040537 A1 2/2013 Schwabel et al.
2013/0125477 A1 5/2013 Adefris
2013/0305614 A1 11/2013 Gaeta et al.
2014/0290147 A1 10/2014 Seth et al.
2016/0186028 A1 6/2016 Louapre et al.
2018/0169836 A1 6/2018 Wilson et al.
2018/0169837 A1 6/2018 Liu
2018/0318983 A1 11/2018 Wilson et al.

* cited by examiner

OPEN COAT ABRASIVE ARTICLE AND METHOD OF ABRADING

Cross Reference to Related Applications

This application is a national stage filing under 35 U.S.C. 371 of PCT/US2017/052618, filed Sep. 21, 2017, which claims the benefit of U.S. Provisional Application No. 62/400,316, filed Sep. 27, 2016, the disclosures of which are incorporated by reference in their entireties herein.

BACKGROUND

The present invention relates generally to abrasive articles that are useful for abrading, finishing and/or grinding a wide variety of materials and surfaces. More particularly, the present invention relates to an open coat abrasive article.

Open coated abrasive articles are generally known in the prior art. U.S. Patent Application 2012/0000135 (Eilers et. al.) discloses an abrasive article in which the make layer, abrasive particle layer, and size layer are coated onto a backing according to a pre-determined coating pattern.

There continues to be a need for improving the cost, performance and/or life of such abrasive articles. In particular, it would be desirable to provide a coated abrasive article with improved cut, longer life, reducing loading, lower cost and/or better surface finish compared with conventional coated abrasive articles.

SUMMARY

The invention overcomes the above-identified limitations in the field by providing a coated abrasive article with improved cut, longer life, reducing loading, lower cost and/or better surface finish compared with conventional coated abrasive articles.

In one embodiment, the present invention provides a coated abrasive article comprising a backing having first and second opposed major surfaces, a first resin (i.e. make coat layer) on at least one major surface of the backing, abrasive particles at least partially embedded in the first resin, and a second resin (i.e. size coat layer) on the first resin and the abrasive particles, wherein the abrasive particles have an average peak count of no greater than about 40,000 per 4 inch×6 inch area (24 square inches or 24 $in^2$) when measured according to the peak count measurement technique described in the specification.

In another embodiment, the present invention provides a coated abrasive article comprising a backing having first and second opposed major surfaces, a first resin on at least one major surface of the backing, abrasive particles at least partially embedded in the first resin, and a second resin on the first resin and the abrasive particles, wherein at least a portion of the abrasive particles are configured to stand upright on the backing and wherein the average number of upright abrasive particles on the backing is no greater than about 40,000 particles per 4 inch×6 inch area (24 square inches or 24 $in^2$).

In another embodiment, the present invention provides a coated abrasive article comprising a backing having first and second opposed major surfaces, a first resin on at least one major surface of the backing, abrasive particles at least partially embedded in the first resin, and a second resin on the first resin and the abrasive particles, wherein the average coating weight of the abrasive particles is at least about 0.1 grain/24 $in^2$ and no greater than about 6 grains/24 $in^2$, and further wherein the abrasive article has an average initial peak count that increases by no more than about 40% during the use of the abrasive article.

In another embodiment, the present invention provides a coated abrasive article comprising a backing having first and second opposed major surfaces, a first resin on at least one major surface of the backing, abrasive particles at least partially embedded in the first resin; and a second resin on the first resin and the abrasive particles wherein at least a portion of the abrasive particles are configured to stand upright on an edge on the backing and wherein no greater than about 15% of the surface area of the backing is covered with abrasive particles.

In other aspects, any of the embodiments described herein may include one or more of the following features: the abrasive particles may comprise shaped abrasive particles, at least about 80% of the abrasive particles may stand upright on the backing, the abrasive particles may include at least one edge and be configured to stand upright on the edge, the make coat may be continuous or discontinuous and no greater than about 25%, no greater than about 15% or no greater than about 10% of the surface area of the backing may be covered with abrasive particles, the surface area located between abrasive particles may be generally flat and smooth, the abrasive particles may have an average grit size of at least about 60 to no greater than about 240, the coating weight of the abrasive particles may be no greater than about 6 grains/24 $in^2$ and at least 80% of the abrasive particles stand upright on the backing, the coating weight of the first resin may be no greater than about 7 grains/24 $in^2$, the coating weight of the second resin is at least about 5 grains/24 $in^2$, the abrasive particles may be randomly distributed on the backing, the backing may be continuous and the opposed major surfaces of the backing may be generally flat and smooth and the backing may be formed of at least one of paper, polymeric film or cloth, the ratio of the abrasive mineral weight to the first resin coat weight may range from about 2:1 to about 1:4, the ratio of the abrasive mineral weight to the second resin coat weight may range from about 1:1 to about 1:25, and/or the ratio of the first resin coat weight to the second resin coat weight may range from about 1:1 to about 1:15.

In a specific embodiment, the present invention provides a coated abrasive disc comprising a backing having smooth continuous opposed first and second major surfaces, a make coat resin on at least one of the first and second opposed major backing surfaces, a plurality of shaped abrasive particles having a generally uniform size and shape arranged on the backing at least partially embedded in the make coat resin, and a size coat resin on the make coat resin and the abrasive particles, wherein at least 90% of the abrasive particles stand upright on the backing and the average height of the abrasive particles standing upright on the backing is at least 3 times the thickness of the make coat resin, the coating weight of the size coat resin is greater than the coating weight of the make coat resin, the shaped abrasive particles have an average peak count of no greater than about 40,000 per 24 $in^2$ when measured according to the test method described in the specification, and the abrasive particles have an average grit size of at least about 60 to no greater than about 240.

In another embodiment, the present invention provides a coated abrasive disc comprising a backing having a smooth continuous first major surface, a make coat resin on the first major surface, a plurality of shaped abrasive particles having a generally uniform size and shape arranged on the backing at least partially embedded in the make coat resin, and a size coat resin on the make coat resin and the abrasive particles, wherein at least 80% of the abrasive particles stand upright on the backing and the average height of the abrasive particles standing upright on the backing is at least 3 times the thickness of the make coat resin, the coating weight of the size coat resin is greater than the coating weight of the make coat resin, the shaped abrasive particles have an average peak count of no greater than about 40,000 per 24 $in^2$ when measured according to the peak count measurement technique described in the specification, and the abrasive particles have an average grit size of at least about 24 and no greater than about 800.

The invention also provides a method of abrading an uncoated metal workpiece during the body-in-white step of manufacturing an automotive vehicle. The method comprises the steps of securing the coated abrasive disc herein to a manually-operated tool configured to rotate the abrasive article, and manually applying the abrasive disc to the workpiece while the disc is rotating, thereby abrading the workpiece.

As used herein, "coated abrasive article" refers to an article with the abrasive material coated on the outer surface of the article (i.e. the abrasive material is not included within the backing).

As used herein, the term "shaped abrasive particle" refers to a ceramic abrasive particle with at least a portion of the abrasive particle having a predetermined shape that is replicated from a mold cavity used to form a precursor shaped abrasive particle which is sintered to form the shaped abrasive particle. Except in the case of abrasive shards (e.g., as described in U.S. Pat. No. 8,034,137 B2 (Erickson et al.)), the shaped abrasive particle will generally have a predetermined geometric shape that substantially replicates the mold cavity that was used to form the shaped abrasive particle. The term "shaped abrasive particle" as used herein excludes abrasive particles obtained by a mechanical crushing operation.

As used herein, a "continuous backing layer" refers to a backing layer that does not contain holes, openings, slits, voids or channels extending there through in the z-direction (i.e. the thickness or height dimension) that are larger than the randomly formed spaces between the material itself when it is made.

An advantage of certain embodiments include the use of less abrasive mineral without experiencing a significant drop in performance. More specifically, the present invention has improved cut, longer life, less loading, lower raw material and production coats, and equivalent surface finish compared to a traditional coated abrasive product. The reduction in raw material cost may be due to a reduction in the amount of shaped abrasive material, or due to a reduction or the elimination of filler material. In embodiments with no filler material, the step of applying filler material is eliminated from the manufacturing process. Thus, an advantage of certain embodiments is simplified and less expensive manufacturing. More specific advantages include good orientation of the abrasive particles and shelling resistance of the abrasive particles.

BRIEF DESCRIPTION OF THE DRAWINGS

The present invention will be further described with reference to the accompanying drawings, in which.

DETAILED DESCRIPTION

Figure 1:
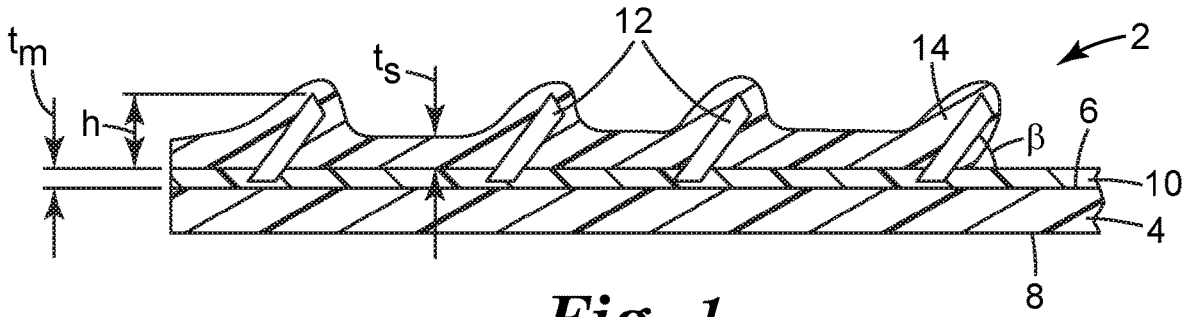
FIG. 1 is a cross sectional view of an abrasive article according to the invention.
Figure 2:
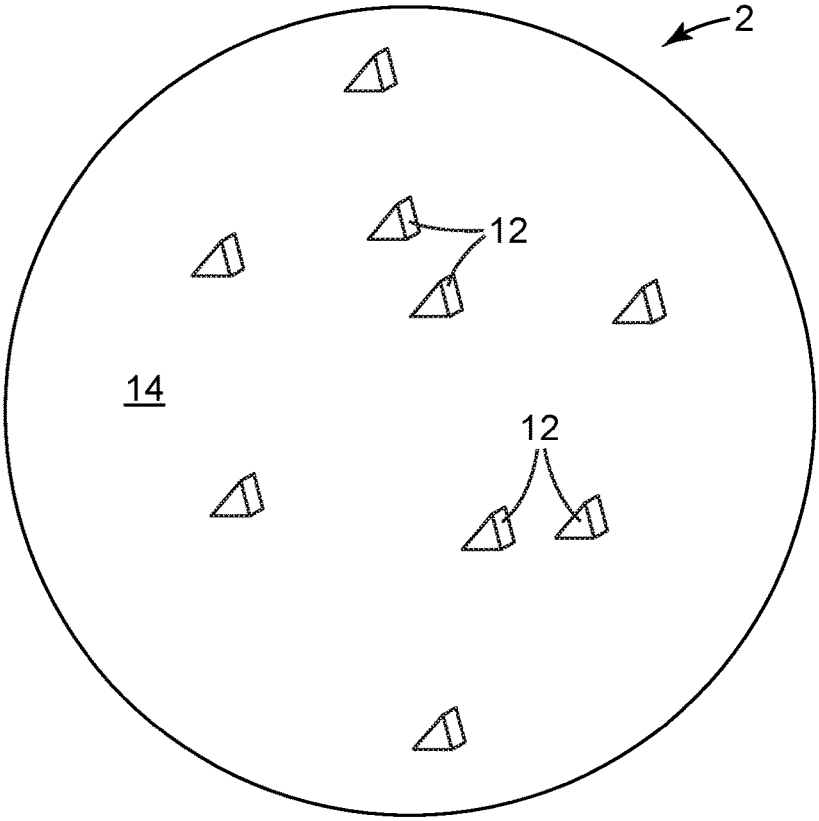
FIG. 2 is a plan view of an abrasive disc according to an embodiment of the invention

Referring now to the drawings, FIGS. 1 and 2 show a coated abrasive article 2 in the form of an abrasive disc. It will be recognized that abrasive articles according to the present disclosure are not limited to discs and may be converted into, for example, endless or continuous belts, discs (including perforated discs), sheets and/or pads. For belt applications, two free ends of a sheet-like abrasive article may be joined together using known methods to form a spliced belt.

The abrasive article 2 generally comprises a backing or substrate 4 having a first major surface 6 and an opposed second major surface 8, an optional make coat 10, a plurality of abrasive particles 12 arranged on the first major surface 6 at least partially embedded in the make coat 10, and a size coat 14 over the make coat and the abrasive particles 12. The abrasive particles 12 may be bonded to the backing 4 using a make coat 4 as shown, or the abrasive particles 12 may be affixed directly to the backing 4 as described in more detail below. Throughout the description and the accompanying figures, functionally similar features are referred to with like reference numerals.

The particular backing or substrate 4 is not critical to the invention hereof, so long as it provides the desired function and properties for the particular coated abrasive article and its intended end use application. In one aspect, the second major surface 8 of the backing 4 to which the abrasive particle 12 are affixed is generally flat and smooth. That is, at least the second major surface 8 to which the make coat 10 and abrasive particles 12 are applied is continuous and has a surface topography that is generally even and level.

A variety of backings 4 materials are suitable for coated abrasive articles according to the present disclosure including, for example, cloth, paper, polymeric films. More specifically, examples of suitable backings 11 include polymeric films, primed polymeric films, cloths, paper, vulcanized fiber, densified nonwovens, treated versions of these, and combinations thereof. The backing 11 may comprise optional additives, for example, fillers, fibers, antistatic agents, lubricants, wetting agents, surfactants, pigments, dyes, coupling agents, plasticizers, and suspending agents. The amounts of these optional materials depend on the properties desired. In addition, the backing 4 may be selected such that it has sufficient strength and heat resistance to withstand its process and use conditions under abrading. Additionally, if the abrasive article is intended to be used in a wet or lubricating environment, the backing 4 may be selected such that it has sufficient water and/or oil resistance, obtained by treating the backing with a thermosetting resin so that it does not degrade during abrading. Useful resins include phenolic resins, which can optionally be modified with rubber; epoxy resins, which can optionally be modified with a fluorene compound; and bismaleimide resins.

Similarly, the particular make coat 10 and size coat 14 is not critical to the invention hereof so long as it provides the desired function and properties for the particular abrasive article and its intended end use application. Suitable make and size coat resins include a wide variety of known resins such as, for example, thermosetting resins, phenolic resins, epoxy resins, urea-formaldehyde resins, acrylate resins, cyanate resins, aminoplast resins, melamine resins, acrylated epoxy resins, urethane resins and combinations thereof. The make coat or size coat, or both coats, may further comprise additives that are known in the art, such as, for example, fillers, grinding aids, wetting agents, surfactants, dyes, pigments, coupling agents, adhesion promoters, and combinations thereof.

In a coated abrasive, the make coat 10 and size coat 14 may collectively be referred to as a binder, and they may be made from the same or different binder precursors. During manufacture of a coated abrasive article, a binder precursor is exposed to an energy source which aids in the initiation of the polymerization or curing of the binder precursor. Examples of energy sources include thermal energy and radiation energy (e.g., electron beam, ultraviolet light, and visible light). During this polymerization process, the binder precursor is polymerized or cured and is converted into a solidified binder.

The binder can be formed of a curable (e.g., via energy such as UV light or heat) organic material. Examples of curable organic binder materials include amino resins, alkylated urea-formaldehyde resins, melamine-formaldehyde resins, and alkylated benzoguanamine-formaldehyde resin, acrylate resins (including acrylates and methacrylates) such as vinyl acrylates, acrylated epoxies, acrylated urethanes, acrylated polyesters, acrylated acrylics, acrylated polyethers, vinyl ethers, acrylated oils, and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins (including alkylalkoxysilane resins), reactive vinyl resins, and phenolic resins (resole and novolac). The resins may be provided as monomers, oligomers, polymers, or combinations thereof.

The binder precursor can be a condensation curable resin, an addition polymerizable resin, a free-radical curable resin, and/or combinations and blends of such resins. One binder precursor is a resin or resin mixture that polymerizes via a free-radical mechanism. The polymerization process is initiated by exposing the binder precursor, along with an appropriate catalyst, to an energy source such as thermal energy or radiation energy. Examples of radiation energy include electron beam, ultraviolet light, or visible light.

Examples of suitable binder precursors include phenolic resins, urea-formaldehyde resins, aminoplast resins, urethane resins, melamine formaldehyde resins, cyanate resins, isocyanurate resins, (meth)acrylate resins (e.g., (meth)acrylated urethanes, (meth)acrylated epoxies, ethylenically-unsaturated free-radically polymerizable compounds, aminoplast derivatives having pendant alpha, beta-unsaturated carbonyl groups, isocyanurate derivatives having at least one pendant acrylate group, and isocyanate derivatives having at least one pendant acrylate group) vinyl ethers, epoxy resins, and mixtures and combinations thereof. As used herein, the term "(meth)acryl" encompasses acryl and methacryl. Ethylenically-unsaturated monomers or oligomers, or (meth)acrylate monomers or oligomers, may be monofunctional, difunctional, trifunctional or tetrafunctional, or even higher functionality.

Phenolic resins have good thermal properties, availability, and relatively low cost and ease of handling. There are two types of phenolic resins, resole and novolac. Resole phenolic resins have a molar ratio of formaldehyde to phenol of greater than or equal to one to one, typically in a range of from 1.5:1.0 to 3.0:1.0. Novolac resins have a molar ratio of formaldehyde to phenol of less than one to one. Examples of commercially available phenolic resins include those known by the trade designations DUREZ and VARCUM from Occidental Chemicals Corp., Dallas, Tex.; RESINOX from Monsanto Co., Saint Louis, Mo.; and AEROFENE and AROTAP from Ashland Specialty Chemical Co., Dublin, Ohio.

(Meth)acrylated urethanes include di(meth)acrylate esters of hydroxyl-terminated NCO extended polyesters or polyethers. Examples of commercially available acrylated urethanes include those available as CMD 6600, CMD 8400, and CMD 8805 from Cytec Industries, West Paterson, N.J.

(Meth)acrylated epoxies include di(meth)acrylate esters of epoxy resins such as the diacrylate esters of bisphenol A epoxy resin. Examples of commercially available acrylated epoxies include those available as CMD 3500, CMD 3600, and CMD 3700 from Cytec Industries.

Ethylenically-unsaturated free-radically polymerizable compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically-unsaturated free-radically polymerizable compounds typically have a molecular weight of less than about 4,000 g/mole and are typically esters made from the reaction of compounds containing a single aliphatic hydroxyl group or multiple aliphatic hydroxyl groups and unsaturated carboxylic acids, such as acrylic acid, methacrylic acid, itaconic acid, crotonic acid, isocrotonic acid, maleic acid, and the like. Representative examples of (meth)acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically-unsaturated resins include monoallyl, polyallyl, and polymethallyl esters and amides of carboxylic acids, such as diallyl phthalate, diallyl adipate, and N,N-diallyladipamide. Still other ethylenically-unsaturated compounds are nitrogen-containing compounds such as tris (2-acryloyl-oxyethyl) isocyanurate, 1,3,5-tris(2-methyacryloxyethyl)-s-triazine, acrylamide, N-methylacrylamide, N,N-dimethylacrylamide, N-vinylpyrrolidone, and N-vinylpiperidone.

Useful aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho- and para-acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group. Isocyanate derivatives having at least one pendant acrylate group are further described in U.S. Pat. No. 4,652,274 (Boettcher et al.). An example of one isocyanurate material is the triacrylate of tris(hydroxyethyl) isocyanurate.

Epoxy resins have one or more epoxy groups that may be polymerized by ring opening of the epoxy group(s). Such epoxy resins include monomeric epoxy resins and oligomeric epoxy resins. Examples of useful epoxy resins include 2,2-bis[4-(2,3-epoxypropoxy)-phenyl propane] (diglycidyl ether of bisphenol) and materials available as EPON 828, EPON 1004, and EPON 1001F from Momentive Specialty Chemicals, Columbus, Ohio; and DER-331, DER-332, and DER-334 from Dow Chemical Co., Midland, Mich. Other suitable epoxy resins include glycidyl ethers of phenol formaldehyde novolac commercially available as DEN-431 and DEN-428 from Dow Chemical Co.

The epoxy resins can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other curing agents (e.g., amine hardeners and guanidines) for epoxy resins and phenolic resins may also be used.

Other cationic curing agents include a salt having an organometallic complex cation and a halogen containing complex anion of a metal or metalloid which are further described in U.S. Pat. No. 4,751,138 (Tumey et al.). Other examples include an organometallic salt and an onium salt as described in U.S. Pat. No. 4,985,340 (Palazzotto et al.); U.S. Pat. No. 5,086,086 (Brown-Wensley et al.); and U.S. Pat. No. 5,376,428 (Palazzotto et al.). Still other cationic curing agents include an ionic salt of an organometallic complex in which the metal is selected from the elements of Periodic Group IVB, VB, VIB, VIIB and VIIIB which is described in U.S. Pat. No. 5,385,954 (Palazzotto et al.).

Free-radically polymerizable ethylenically-unsaturated compounds polymerize on exposure to free-radicals formed by decomposition of free-radical thermal initiators and/or photoinitiators, or by exposure to particulate (electron beam) or high energy radiation (gamma rays). Compounds that generate a free-radical source if exposed to actinic electromagnetic radiation (e.g., ultraviolet or visible electromagnetic radiation) are generally termed photoinitiators.

Examples of free-radical thermal initiators include peroxides, e.g., benzoyl peroxide and azo compounds.

Examples of photoinitiators include benzoin and its derivatives such as alpha-methylbenzoin; alpha-phenylbenzoin; alpha-allylbenzoin; alpha-benzylbenzoin; benzoin ethers such as benzil dimethyl ketal (e.g., as commercially available as IRGACURE 651 from Ciba Specialty Chemicals, Tarrytown, N.Y.), benzoin methyl ether, benzoin ethyl ether, benzoin n-butyl ether; acetophenone and its derivatives such as 2-hydroxy-2-methyl-1-phenyl-1-propanone (e.g., as DAROCUR 1173 from Ciba Specialty Chemicals) and 1-hydroxycyclohexyl phenyl ketone (e.g., as IRGACURE 184 from Ciba Specialty Chemicals); 2-methyl-1-[4-(methylthio)phenyl]-2-(4-morpholinyl)-1-propanone (e.g., as IRGACURE 907 from Ciba Specialty Chemicals; 2-benzyl-2-(dimethylamino)-1-[4-(4-morpholinyl)phenyl]-1-butanone (e.g., as IRGACURE 369 from Ciba Specialty Chemicals). Other useful photoinitiators include, for example, pivaloin ethyl ether, anisoin ethyl ether, anthraquinones (e.g., anthraquinone, 2-ethylanthraquinone, 1-chloroanthraquinone, 1,4-dimethylanthraquinone, 1-methoxyanthraquinone, or benzanthraquinone), halomethyltriazines, benzophenone and its derivatives, iodonium salts and sulfonium salts, titanium complexes such as bis(eta.sub.5-2,4-cyclopentadien-1-yl)-bis[2,6-difluoro-3-(1H-pyrrol-1-yl)phenyl]titanium (e.g., as CGI 784DC from Ciba Specialty Chemicals); halonitrobenzenes (e.g., 4-bromomethylnitrobenzene), mono- and bis-acylphosphines (e.g., as IRGACURE 1700, IRGACURE 1800, IRGACURE 1850, DAROCUR 4263, and DAROCUR 4265 all from Ciba Specialty Chemicals, and 2,4,6-trimethylbenzoyl-diphenylphosphine oxide available as LUCIRIN TPO from BASF Corporation, Charlotte, N.C.). Combinations of photoinitiators may be used.

Typically, the curative (e.g., free-radical initiator (photo or thermal) or cationic cure catalyst) is used in amounts ranging from 0.1 to 10 percent, preferably 2 to 4 percent by weight, based on the weight of the binder material precursor, although other amounts may also be used. Additionally, it is preferred to uniformly disperse or dissolve the initiator in the binder matrix precursor prior to the addition of any particulate material, such as the abrasive particles and/or filler particles. One or more spectral sensitizers (e.g., dyes) may be used in conjunction with the photoinitiator(s), for example, in order to increase sensitivity of the photoinitiator to a specific source of actinic radiation. Examples of suitable sensitizers include thioxanthone and 9,10-anthraquinone. In general, the amount of photosensitizer may vary from about 0.01 to 10 percent by weight, more preferably from 0.25 to 4.0 percent by weight, based on the weight of the binder material precursor. Examples of photosensitizers include those available as QUANTICURE ITX, QUANTICURE QTX, QUANTICURE PTX, QUANTICURE EPD from Biddle Sawyer Corp., New York, N.Y.

A wide variety of abrasive particles may be utilized in the various embodiments described herein. The particular type of abrasive particle 12 (e.g. size, shape, chemical composition) is not considered to be particularly significant to the abrasive article 2, so long as at least a portion of the abrasive particles 12 are capable of exhibiting and/or achieving the desired orientation. In accordance with one aspect of the invention, at least a portion of the abrasive particles are shaped abrasive particles. In a specific embodiment, the abrasive particles consist essentially of shaped abrasive particles. That is, the abrasive article includes few, if any, abrasive particles that are not shaped abrasive particles.

The abrasive particles 12 may be provided in a variety of shapes and profiles, including, for example, regular (e.g. symmetric) profiles such as square, star-shaped or hexagonal profiles, and irregular (e.g. asymmetric) profiles. In one embodiment, the abrasive particles have an aspect ratio of at least about 4:1. In another embodiment, the abrasive particles may have a generally symmetric profile and include at least one point.

Figure 3A:
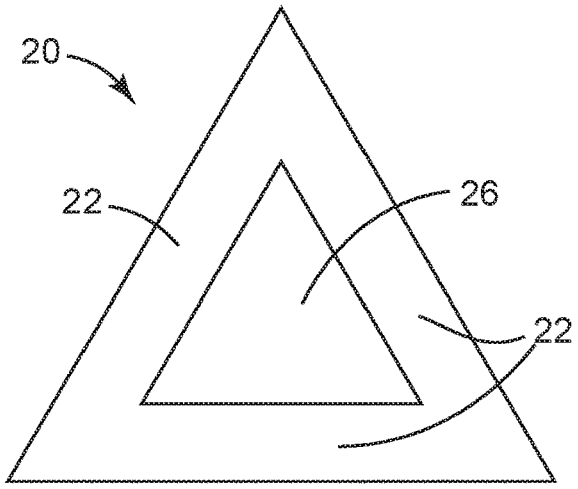
FIG. 3A is a plan view of an exemplary shaped abrasive particle.
Figure 3B:
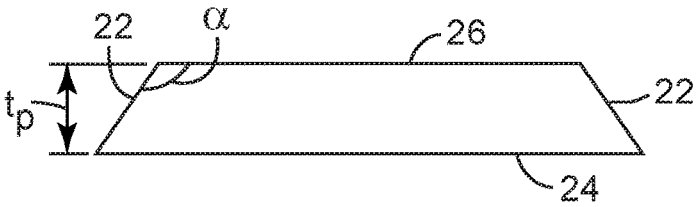
FIG. 3B is a side view of the shaped abrasive particle of FIG. 3A.

Referring now to FIGS. 3A and 3B, there is shown a specific abrasive particle 12 suitable for use in the embodiments described herein. The shaped abrasive particle 12 includes a sloping sidewall 22 and comprises a thin body having a first face 24 and a second face 26, and having a thickness $t_p$. The first face 24 and the second face 26 are connected to each other by at least one sloping sidewall 22. In some embodiments, more than one sloping sidewall 22 may be present and the slope or angle for each sloping sidewall 22 may be the same as shown in FIGS. 3A and 3B, or the slope may be different. A particularly suitable shaped abrasive particle is described in, for example, U.S. Pat. No. 8,142,531 (Adefris et al.), the entire contents of which are hereby incorporated by reference.

In the embodiment illustrated in FIG. 2, the abrasive particles 12 are distributed randomly on the backing 4. In other embodiments, the abrasive particles 12 may be provided in a repeating pattern and/or in a uniform distribution.

The coated abrasive article 2 may include a mixture of abrasive particles that are inclined on the backing (i.e. stand upright and extend outwardly from the backing) as well as abrasive particles that lie flat on their side (i.e. they do not stand upright and extend outwardly from the backing).

In some embodiments, suitable abrasive particles will possess an elongate edge and will be capable of being positioned upright on the elongate edge. More specifically, suitable abrasive particles may possess a length and thickness that define an elongate edge, or a width and thickness that define an elongate edge, and the length and width are each greater than the thickness. Configured as such, suitable abrasive particles may be described as having a plate-like shape, or as "platey abrasive particles." Suitable platey abrasive particles include both crushed abrasive particles and shaped abrasive particles. Suitable abrasive particles also include abrasive agglomerates having plate-like shapes.

In another embodiment, at least a portion of the abrasive particles include a base, and the abrasive particles are configured to rest on the base in an upright position so as to project outwardly from the substrate.

As alluded to above, the coated abrasive article 2 may include a mixture of different types of abrasive particles. For example, the abrasive article 2 may include mixtures of platey and non-platey particles, crushed and shaped particles (which may be discrete abrasive particles that do not contain a binder or agglomerate abrasive particles that contain a binder), conventional non-shaped and non-platey abrasive particles (e.g. filler material) and abrasive particles of different sizes, so long as at least a portion of the abrasive particles have a plate-like shape or are otherwise capable of exhibiting the desired degree of rotational orientation.

Examples of suitable shaped abrasive particles can be found in, for example, U.S. Pat. No. 5,201,916 (Berg) and U.S. Pat. No. 8,142,531 (Adefris et al.) A material from which the shaped abrasive particles 12 may be formed comprises alpha alumina. Alpha alumina shaped abrasive particles can be made from a dispersion of aluminum oxide monohydrate that is gelled, molded to shape, dried to retain the shape, calcined, and sintered according to techniques known in the art.

U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them). Details concerning such shaped abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Examples of suitable crushed abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minn., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.). Many such abrasive particles, agglomerates, and composites are known in the art.

Examples of sol-gel-derived abrasive particles from which crushed abrasive particles can be isolated, and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such as, for example, those described in U.S. Pat. No. 4,652,275 (Bloecher et al.) or U.S. Pat. No. 4,799,939 (Bloecher et al.).

The crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

Examples of suitable platey crushed abrasive particles can be found in, for example, U.S. Pat. No. 4,848,041 (Kruschke), the entire contents of which are hereby incorporated by reference.

The abrasive particles may be surface-treated with a coupling agent (e.g., an organosilane coupling agent) or other physical treatment (e.g., iron oxide or titanium oxide) to enhance adhesion of the crushed abrasive particles to the binder.

In accordance with a characterizing aspect of the invention, the abrasive article 2 is an open coat abrasive article that is more open than what was previously thought to be desirable. This is, with abrasive articles according to the various embodiments of the present disclosure, less of the backing is covered with abrasive grain than what was previously believed to be necessary.

A closed coat abrasive layer is defined as the maximum weight of abrasive particles or a blend of abrasive particles that can be applied to a make coat of an abrasive article in a single pass through the maker. An open coat is an amount of abrasive particles or a blend of abrasive particles weighing less than the maximum weight in grams that can be applied that is applied to a make coat of a coated abrasive article. An open coat abrasive layer will result in less than 100% coverage of the make coat with abrasive particles thereby leaving open areas and a visible resin layer between the particles. In various embodiments, the percent open area in the abrasive layer may be at least about 75%, at least about 85%, at least about 90%, at least about 92% or at least about 95%. Stated differently, in certain embodiments, less than about 25%, less than about 15%, less than about 10%, less than about 8% or less than about 5% of the surface area of the backing 4 second major surface 8 is covered with abrasive particles 12. For certain end use applications, it has been found that by using less abrasive grain, cost is reduced, loading is reduced, and cut and life are improved without sacrificing surface finish—that is, surface finish remains generally equivalent compared to a similar product with a less open coat abrasive density.

As described in more detail below, the degree of openness of the abrasive particles used in the various embodiments described herein may be characterized in terms of the number of tip peaks within a defined area (i.e. average peak count), the average number of upright particles within a defined area (i.e. average upright particle density), the surface area of the backing covered by abrasive particles, and/or the average coating weight of the abrasive particle combined with the percent of abrasive particles standing upright.

In one aspect, the abrasive article 2 includes shaped abrasive particles having an average peak count of no greater than about 40,000 per 24 $in^2$, no greater than about 30,000 per 24 $in^2$, and no greater than about 25,000 per 24 $in^2$. Average peak count is measured according the "Peak Count Measurement" technique described in the Examples section below. The average peak count is a measure of the number of tips of upright abrasive particles within a given area of the abrasive article.

In another aspect, at least a portion of the abrasive particles 12 are configured to stand upright on the backing 4, and the average density of the abrasive particles standing upright on the backing is no greater than about 54,000 particles per 24 $in^2$, no greater than about 40,000 particles per 24 $in^2$, or no greater than about 27,000 particles per 24 $in^2$. In a more specific aspect, at least about 50%, at least about 75%, at least about 80% or at least about 85% of the shaped abrasive particles are arranged in an upright position on the backing 4.

In yet another aspect, the average coating weight of the abrasive particles is no greater than about 6 grains/24 $in^2$, no greater than about 5 grains/24 $in^2$, or no greater than about 4 grains/24 $in^2$. In a further aspect, at least about 60%, at least about 70% or at least about 80% of the abrasive particles stand upright on the backing. And in yet another aspect, the abrasive article has an average initial peak count that increases by no more than about 40%, no more than about 30%, no more than about 20%, no more than about 10%, or no more than about 5% over the course of its useful life.

In the embodiment illustrated in FIGS. 1 and 2, the abrasive article 2 includes only shaped abrasive particles. In one embodiment, the peak height of the upright abrasive particles is generally uniform. That is, the abrasive particles have the same general height and are oriented at a similar angle such that the tips of the upright abrasive particles are arranged approximately the same distance from the backing.

In another aspect, the abrasive particles have an average grit size ranging from at least about 24, at least about 36 or at least about 60 to no greater than about 800, no greater than about 400 or no greater than about 240.

In accordance with another aspect of the invention, it has been found that when the amount of make coat resin applied to the backing is properly controlled, the number of abrasive particles that will remain standing upright on the backing can be maximized. More particularly, it has been found that when the amount of make coat resin applied to the backing is within a certain range for a given abrasive particle size, the number of abrasive particles that will remain standing upright on the backing can be maximized. For example, while not wishing to be limited by theory, it is believed that if too much make coat resin is applied to the backing and the abrasive particles are applied to the backing, surface tension between the make coat resin and the abrasive particle will cause the upright abrasive particles to tip over and lie on their side. That is, the make coat resin may wick up the sides of the abrasive particles, thereby creating a destabilizing force that tends to pull on the abrasive particles and cause them to tip over. This effect may be magnified if the upright abrasive particles are arranged at an angle relative to the backing rather than standing upright in a generally vertical orientation on the backing.

Unexpectedly, it has been found that by reducing the amount of make coat on the backing, the wicking effect can be reduced, and more particles will remain standing upright on the backing. Increasing the number of abrasive particles standing upright on the backing by reducing the amount of make coat resin is surprising and unexpected. It was conventionally believed that more make coat resin would result in a larger percentage of abrasive particles standing upright because it provided more support for the abrasive particles. Thus, reducing the amount of make coat to increase the percentage of abrasive particles standing upright is counter-intuitive.

Moreover, it has been found that if the amount of make coat provided on the backing is too low, upright abrasive particles have a tendency to tip over because the amount of make coat is insufficient to maintain the abrasive particles in an upright position. Accordingly, providing too much make coat or too little make coat can have an adverse impact the percentage of abrasive particles standing upright on the backing.

It has also been found that lowering the amount of make coat resin to maximize the number of abrasive particles that stand upright may cause the abrasive particles to be bonded less securely to the backing. This may cause the abrasive particles to release prematurely from the backing in what is sometimes referred to as shelling. This has been found to be the case even when a conventional size coat is applied over the make coat and abrasive particles to hold the abrasive particles in place more securely.

Shelling also tends to occur in embodiments where the make coat resin is eliminated and the abrasive particles are bonded directly to the backing. In such an embodiment abrasive particles may be coated directly onto, for example, a thermoplastic film backing that has been heated to a temperature sufficient to allow the abrasive particles to bond directly to the backing when the abrasive particles are applied to the backing. In this manner, the need for a make coat is eliminated. Alternatively, the abrasive particles may be heated and applied to an unheated thermoplastic film backing. In either situation, the attachment force between the abrasive particles to the backing tends to be undesirably low. That is, the abrasive particles tend to be weakly bonded to the backing and, as such, tend to prematurely detach from the backing during processing or use.

A number of factors appear to influence whether a particular abrasive particle will remain standing upright on the backing or tip over. These factors include, for example, the amount of make coat resin applied to the backing (e.g. the coat weight and/or the thickness of the make coat), the type of make coat resin used (e.g. the composition and viscosity), and the shape, size, material and orientation of the abrasive particles.

In specific embodiments, the coating weight of the make coat resin is no greater than about 10 grains/24 $in^2$, no greater than about 7 grains/24 $in^2$, or no greater than about 5 grains/24 $in^2$. It has been found that for a variety of sizes, shapes, and orientations of abrasive particles, a suitable number of abrasive particles will remain upright on the backing if the amount of make coat applied to the backing is in the stated ranges. More specifically, it has been found that when abrasive particles such as those shown and described in reference to FIGS. 3A and 3B are applied to a backing having a make coat in the stated ranges, at least about 50%, at least about 75%, at least about 80% or at least about 85% of the abrasive particles will stand upright. It will be noted that when abrasive particles as shown in FIGS. 3A and 3B are applied to a backing, the abrasive particles will be oriented upright as shown in FIG. 1. More specifically, the included angle β between the abrasive particle 12 and the backing 4 will generally range from at least about 50 degrees to no greater than about 85 degrees.

In more specific embodiments, the coating weight of the size coat resin is at least about 5 grains/24 $in^2$, at least about 8 grains/24 $in^2$, or at least about 12 grains/24 $in^2$. In particular, it has been found that by providing a size coat resin in the stated ranges, abrasive particles such as those shown in FIGS. 3A and 3B—when bonded to a backing using the quantity of make coat resin described herein—will form an abrasive article suitable for many abrading, grinding and finishing applications. That is, the abrasive particles will be bonded securely enough to withstand the forces encountered in a wide variety of end-use applications.

The desired amount of make coat resin for a particular abrasive particle may also be characterized in terms of the relationship between the average thickness of the open region (i.e. the region not adjacent the abrasive particles where the surface of the make coat is generally planar and the thickness of the make coat is not influenced by the abrasive particles) of the make coat layer 10 ($t_m$ in FIG. 1) and the average inclined height of the abrasive particles 12 (h in FIG. 1). In various embodiments, the average thickness of the open region of the make coat layer is no more than about 30%, no more than about 20%, or no more than about 10% of the average included height of the abrasive particles 12.

In addition, the desired amount of make coat resin and size coat resin may be characterized in terms of the relationship between the average thickness of the open region of the make coat layer and the average thickness of the open region of the size coat (i.e. the region not adjacent the abrasive particles). For example, in one embodiment, the average thickness of the open region of the make coat layer $t_m$ is no greater than the average thickness of the open region of the size coat layer $t_s$. In more specific embodiments, the average thickness of the open region of the make coat layer $t_m$ is no greater than about 75% or no greater than about 50% of the average thickness of the open region of the size coat layer $t_s$.

In a more specific aspect, the ratio of the abrasive mineral weight to the make coat resin weight ranges from about 2:1 to about 1:4. In another aspect, the ratio of the abrasive mineral weight to the size coat resin weight ranges from about 1:1 to about 1:25. And in another aspect, the ratio of the first resin coat weight to the second resin coat weight ranges from about 1:1 to about 1:15

Figure 4:
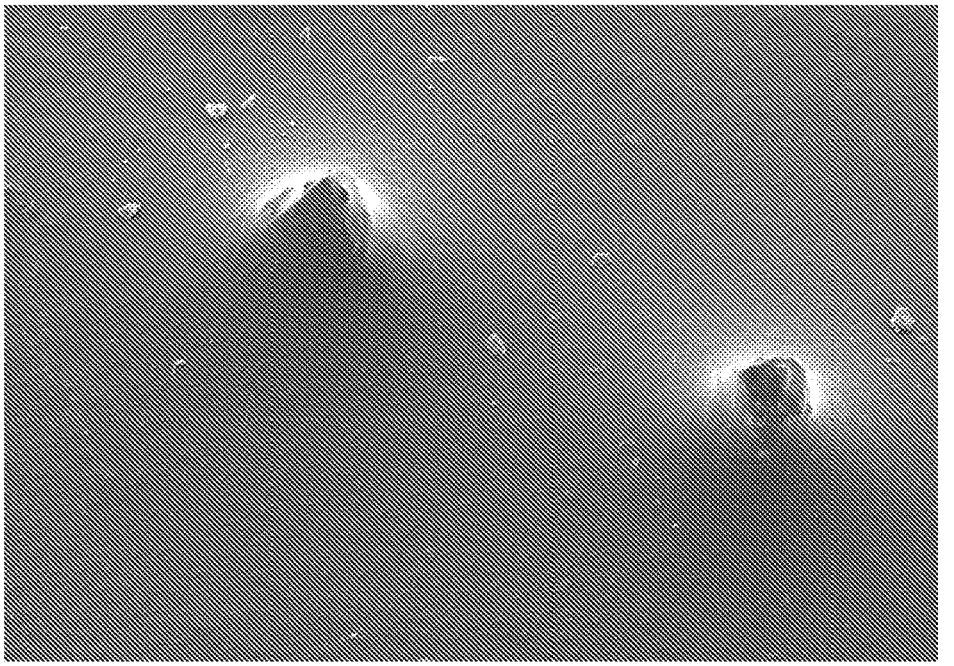
FIG. 4 is a photomicrograph of the top surface of a coated abrasive article according to an embodiment of the invention.

In the embodiment shown in the photomicrograph in FIG. 4, the region between the abrasive particles 12 is generally flat and smooth, and is substantially free of abrasive particles lying flat and/or filler material. In this manner, the work done by the abrasive particle is maximized, and loading is minimized.

Referring again to FIGS. 1 and 2, there is shown a coated abrasive disc 2 comprising a backing 4 having smooth, continuous co-planar first 6 and second 8 major surfaces, a make coat resin 10 provided on the first major surface 6 of the backing 4, a plurality of shaped abrasive particles 12 having a generally uniform size and shape arranged on the backing 4 at least partially embedded in the make coat resin 10, and a size coat resin 14 provided over the make coat resin 10 and the abrasive particles 12. In a specific aspect, at least about 75%, at least about 80%, at least about 85%, or at least about 90% of the abrasive particles 12 stand upright on the backing 4, and the average height of the abrasive particles 12 standing upright on the backing 4 is at least about 2, at least about 3, or at least about 4 times the average thickness of the make coat resin layer 10. In a more specific aspect, the coating weight of the size coat resin is greater than the coating weight of the make coat resin. In another specific aspect, the shaped abrasive particles have an average peak count of no greater than about 40,000 per 24 $in^2$, no more than about 30,000 per 24 $in^2$, or no more than about 25,000 per 24 $in^2$. And in yet another specific aspect, the abrasive particles 12 have an average grit size of at least about 24, at least about 40, at least about 50 or at least about 60, and no greater than about 800, no greater than about 320, no greater than about 280, or no greater than about 240.

Certain embodiments described herein are particularly useful for abrading a metal workpiece during the body-in-white step of manufacturing an automotive vehicle. For example, the embodiment of FIGS. 1 and 2 may be used in such an application by securing the coated abrasive disc 2 to a manually-operated tool configured to rotate the abrasive disc, and manually applying the abrasive disc to the workpiece while the disc is rotating, thereby abrading the workpiece.

The abrasive article 2 according to the various embodiments described herein may be produced using conventional techniques. For example, the abrasive particles 12 may be coated onto the backing 4 using known electrostatic coating techniques or by passing the abrasive particles 12 through an alignment device, whereby the abrasive particles 12 emerge from and impinge upon the backing. The alignment device may comprise, for example, a plurality of elongate slots formed using, for example, a plurality of wires or strings, a screen containing elongate openings, or a comb-like structure having a plurality of walls that define elongate openings. The abrasive particles may be passed through the alignment device using, for example, forced air, by electrostatically propelling them, by dropping them on, for example, a rotating drum, or by gravity feeding them through the alignment device. Specific techniques useful for applying the abrasive particles 12 to the backing 4 are described in PCT Publ. Nos. PCT/US2017/007703, PCT/US2017/205267 and PCT/US2017/007714, the entire contents of which are hereby incorporated by reference.

EXAMPLES

Objects and advantages of this disclosure are further illustrated by the following non-limiting examples, but the particular materials and amounts thereof recited in these examples, as well as other conditions and details, should not be construed to unduly limit this disclosure. Unless otherwise noted, all parts, percentages, ratios, etc. in the Examples and the rest of the specification are by weight.

Unless stated otherwise, all other reagents were obtained, or are available from vendors such as Sigma-Aldrich Company, St. Louis, Mo., or may be synthesized by known methods.

Unit Abbreviations Used in the Examples:

° C.: degrees Centigrade cm: centimeter $g/m^2$: grams per square meter mm: millimeter Abrasive Particles Used in the Examples:

TABLE 1

| ABBREVIATION | DESCRIPTION |
|---|---|
| AP1 | Shaped abrasive particles were prepared according to the disclosure of U.S. Pat. No. 8,142,531 (Adefris et al). The shaped abrasive particles were prepared by molding alumina sol gel in equilateral triangle-shaped polypropylene mold cavities. After drying and firing, the resulting shaped abrasive particles were about 0.33 mm (side length) × 0.10 mm thick, with a draft angle approximately 98 degrees. |
| AP2 | Shaped abrasive particles were prepared according to the disclosure of U.S. Pat. No. 8,142,531 (Adefris et al). The shaped abrasive particles were prepared by molding alumina sol gel in equilateral triangle-shaped polypropylene mold cavities. After drying and firing, the resulting shaped abrasive particles were about 0.52 mm (side length) × 0.15 mm thick, with a draft angle approximately 98 degrees. |
| AP3 | Shaped abrasive particles were prepared according to the disclosure of U.S. Pat. No. 8,142,531 (Adefris et al). The shaped abrasive particles were prepared by molding alumina sol gel in equilateral triangle-shaped polypropylene mold cavities. After drying and firing, the resulting shaped abrasive particles were about 0.20 mm (side length) × 0.05 mm thick, with a draft angle approximately 98 degrees. |
| AP4 | Ceramic alumina crushed mineral conforming the FEPA (Federation of the European Producers of Abrasives) standard for P36, obtained "CERAMIC ABRASIVE GRAIN 222" from 3M Company, Saint Paul, Minnesota. |

Example 1

Paper backing having a basis weight of 244-256 $g/m^2$, obtained under the trade designation "NODUST B-250-VSNATURAL" from Munksjo Paper Inc., Stockholm, Sweden, was coated with 6.7 grains per 4×6 inches (28.0 $g/m^2$) of a phenolic make resin consisting of 91.36 parts of resole phenolic resin (obtained under trade designation "GP 8339 R-23155B" from Georgia Pacific Chemicals, Atlanta, Ga.), 0.07 parts of a non-ionic ester type surfactant (obtained under trade designation "INTERWET 33" from AKCROS Chemicals America, New Brunswick, N.J.), and 8.57 parts of water using a roll coating method.

Abrasive particles AP1 were applied to the make resin-coated backing by electrostatic coating. The coating weight of AP1 was 4.8 grains per 4×6 inches (20.1 $g/m^2$). The abrasive coated backing roll was placed in an oven at 79° C. for 15 minutes, followed by 30 minutes at 90° C., followed by 45 minutes at 97° C. to partially cure the make resin. A size resin consisting of 50.53 parts of resole phenolic resin (obtained under trade designation "GP 8339 R-23155B" from Georgia Pacific Chemicals), 7.37 parts of water, 39.92 parts calcium carbonate (obtained under trade designation "HUBERCARB Q325" from Huber Carbonates, LLC, Atlanta, Ga.), 0.08 parts of a non-ionic ester type surfactant (obtained under trade designation "INTERWET 33" from AKCROS Chemicals America), 0.50 parts 1-methoxy-2-propanol (obtained under trade designation "GLYCOL ETHER PM SOLVENTS" from Lyondell Chemical Company, Houston, Tex.) and 1.60 parts red iron oxide was applied to the backing material at a basis weight of 22 grains per 4×6 inches (92.1 $g/m^2$), and the coated backing roll was placed in an oven at 79° C. for 15 minutes, followed by 20 minutes at 96° C., followed by 2.5 hours at 104° C. After cure, the strip of coated abrasive was converted into a 5-inch (12.7-cm) diameter disc as is known in the art.

Examples 2 to 11 and Comparative Examples A to D

The procedure generally described in Example 1 was repeated, with the exception that the coating weights of abrasive particles AP1, make resin and size resin listed in Table 2 were used for each of Examples 2 through 11 and Comparative Examples s A through D.

TABLE 2

| | Abrasive Particle AP1 Coating Weight in grains per 4 × 6 inches | Make Resin Coating Weight in grains per 4 × 6 inches | Size Resin Coating Weight in grains per 4 × 6 inches |
|---|---|---|---|
| Example 2 | 1.2 (5.0 $g/m^2$) | 4.6 (19.3 $g/m^2$) | 26 (108.8 $g/m^2$) |
| Example 3 | 2.8 (11.7 $g/m^2$) | 4.6 (19.3 $g/m^2$) | 24 (100.4 $g/m^2$) |
| Example 4 | 3.6 (15.1 $g/m^2$) | 4.6 (19.3 $g/m^2$) | 29 (121.4 $g/m^2$) |
| Example 5 | 4.6 (19.3 $g/m^2$) | 4.6 (19.3 $g/m^2$) | 26 (108.8 $g/m^2$) |
| Example 6 | 1.6 (6.7 $g/m^2$) | 4.6 (19.3 $g/m^2$) | 27 (113.0 $g/m^2$) |
| Example 7 | 4.0 (16.7 $g/m^2$) | 4.6 (19.3 $g/m^2$) | 30 (125.5 $g/m^2$) |
| Example 8 | 5.0 (20.9 $g/m^2$) | 4.6 (19.3 $g/m^2$) | 32 (133.9 $g/m^2$) |
| Example 9 | 5.5 (23.0 $g/m^2$) | 4.6 (19.3 $g/m^2$) | 33 (138.1 $g/m^2$) |
| Example 10 | 7.0 (29.3 $g/m^2$) | 4.6 (19.3 $g/m^2$) | 35 (146.5 $g/m^2$) |
| Example 11 | 3.0 (12.6 $g/m^2$) | 2.8 (11.7 $g/m^2$) | 20 (83.7 $g/m^2$) |
| Comparative Example A | 26.4 (110.5 $g/m^2$) | 4.6 (19.3 $g/m^2$) | 27 (113.0 $g/m^2$) |
| Comparative Example B | 18.5 (77.4 $g/m^2$) | 4.6 (19.3 $g/m^2$) | 24 (100.4 $g/m^2$) |
| Comparative Example C | 14.5 (60.7 $g/m^2$) | 4.6 (19.3 $g/m^2$) | 22 (92.0 $g/m^2$) |
| Comparative Example D | 9.0 (37.7 $g/m^2$) | 4.6 (19.3 $g/m^2$) | 20 (83.7 $g/m^2$) |

Example 12

The procedure generally described in Example 1 was repeated, with the exception that 4.1 grains per 4×6 inches (17.2 $g/m^2$) of make coat, 16 grains per 4×6 inches (67.0 $g/m^2$) of size coat were applied, and AP4 with coating weight of 3.7 grains per 4×6 inches (15.5 $g/m^2$) was used as abrasive particles instead of AP1.

Comparative Example E

Abrasive paper disc obtained under trade designation "HOOKIT PAPER DISC 763U GRADE P120" from 3M Company, Saint Paul, Minn.

Example 13

The procedure generally described in Example 1 was repeated, with the exception that 5.2 grains per 4×6 inches (21.8 g/m$^2$) of make coat, 13 grains per 4×6 inches (54.4 g/m$^2$) of size coat were applied, and AP2 with coating weight of 5.5 grains per 4×6 inches (23.0 g/m$^2$) was used as abrasive particles instead of AP1.

Example 14

The procedure generally described in Example 1 was repeated, with the exception that 5.2 grains per 4×6 inches (21.8 g/m$^2$) of make coat, 21 grains per 4×6 inches (87.9 g/m$^2$) of size coat were applied, and AP2 with coating weight of 5.5 grains per 4×6 inches (23.0 g/m$^2$) was used as abrasive particles instead of AP1.

Comparative Example F

Abrasive paper disc obtained under trade designation "HOOKIT PAPER DISC 763U GRADE P80" from 3M Company, Saint Paul, Minn.

Comparative Example G

Abrasive paper disc obtained under trade designation "CUBITRON II HOOKIT CLEAN SANDING FILM DISC 775L" grade P80 from 3M Company.

Example 15

Paper backing having a basis weight of 244-256 g/m$^2$, obtained under the trade designation "NODUST B-250-VSNATURAL" from Munksjo Paper Inc., Stockholm, Sweden, was coated with 3.1 grains per 4×6 inches (13.0 g/m$^2$) of a phenolic make resin consisting of 91.36 parts of resole phenolic resin (obtained under trade designation "GP 8339 R-23155B" from Georgia Pacific Chemicals, Atlanta, Ga.), 0.07 parts of a non-ionic ester type surfactant (obtained under trade designation "INTERWET 33" from AKCROS Chemicals America, New Brunswick, N.J.), and 8.57 parts of water using a roll coating method.

Abrasive particles AP3 were applied to the make resin-coated backing by electrostatic coating. The coating weight of AP3 was 2.0 grains per 4×6 inches (8.4 g/m$^2$). The abrasive coated backing roll was placed in an oven at 79° C. for 15 minutes, followed by 30 minutes at 90° C., followed by 45 minutes at 97° C. to partially cure the make resin. A size resin consisting of 77.12 parts of resole phenolic resin (obtained under trade designation "GP 8339 R-23155B" from Georgia Pacific Chemicals), 2.39 parts of water, 15.66 parts calcium carbonate (obtained under trade designation "GAMACO" from Imerys, Roswell, Ga.), 0.12 parts of a non-ionic ester type surfactant (obtained under trade designation "INTERWET 33" from AKCROS Chemicals America, New Brunswick, N.J.), 0.79 parts 1-methoxy-2-propanol (obtained under trade designation "GLYCOL ETHER PM SOLVENTS" from Lyondell Chemical Company, Houston, Tex.) and 3.92 parts red iron oxide was applied to the backing material at a basis weight of 6.0 grains per 4×6 inches (25.1 g/m$^2$), and the coated backing roll was placed in an oven at 79° C. for 15 minutes, followed by 20 minutes at 96° C., followed by 2.5 hours at 104° C. After cure, the strip of coated abrasive was converted into a 5-inch (12.7-cm) diameter disc as is known in the art.

Example 16

The procedure generally described in Example 1 was repeated, with the exception that 3.5 grains per 4×6 inches (14.6 g/m$^2$) of make coat, 8.0 grains per 4×6 inches (33.5 g/m$^2$) of size coat, and 2.3 grains per 4×6 inches (9.6 g/m$^2$) of AP3 were applied.

Example 17

The procedure generally described in Example 1 was repeated, with the exception that 3.5 grains per 4×6 inches (14.6 g/m$^2$) of make coat, 12 grains per 4×6 inches (50.2 g/m$^2$) of size coat, and 3 grains per 4×6 inches (12.6 g/m$^2$) of AP3 were applied.

Comparative Example H

Abrasive paper disc obtained under trade designation "CUBITRON II HOOKIT CLEAN SANDING FILM DISC 775L" grade P180 from 3M Company.

Performance Test

A 5-inch (12.7-cm) diameter abrasive disc to be tested was mounted on an electric random orbital tool that was disposed over an X-Y table. An OEM panel measuring 18 inches×24 inches×0.8 inches (457.2 mm×609.6 mm×2 mm) without paint coating layer was secured to the X-Y table. The tool was then set to traverse at a rate of 20 inches/second (508 mm/second) in the Y direction along the length of the panel; and a traverse along the width of the panel at a rate of 1.6 inches/second (406 mm/second). Four such passes along the length of the panel were completed in each cycle. The Servo motor of the tool was then set to rotate at 10,000 revolutions per minute under no load. The abrasive article was then urged at an angle of 2.5 degrees against the panel at a load of 10 pounds (4.54 kilograms). The tool was then activated to move through the prescribed path. The mass of the panel was measured before and after each cycle to determine the mass loss in grams after each cycle. When the mass loss after a cycle dropped below 0.40 grams, the test stopped. Total cut was measured as the cumulative mass loss in grams at the end of the test. The surface finish was measured as the average surface roughness ($R_a$) in micro-inches (1 micro-inch equals to 25.4 nanometers) using a contact profilometer such as a Mahr Perthometer M2 from Mahr Federal Inc, Providence, R.I. The test results are shown in Table 3.

TABLE 3

| | Total Cut (grams) | $R_a$, (micro-inches) |
|---|---|---|
| Example 1 | 2.75 | 27.3 |
| Example 2 | 3.35 | 34.0 |
| Example 3 | 3.49 | 29.3 |
| Example 4 | 3.02 | 25.0 |
| Example 5 | 2.33 | 25.7 |
| Example 6 | 2.76 | — |
| Example 7 | 1.96 | — |
| Example 8 | 2.80 | — |
| Example 9 | 1.96 | — |
| Example 10 | 1.65 | — |
| Example 12 | 1.15 | 24.2 |

TABLE 3-continued

| | Total Cut (grams) | $R_a$, (micro-inches) |
|---|---|---|
| Comparative Example A | 1.24 | — |
| Comparative Example B | 1.15 | — |
| Comparative Example C | 1.14 | — |
| Comparative Example D | 1.30 | — |
| Comparative Example E | 1.07 | 30.3 |
| Example 13 | 3.06 | 45.0 |
| Example 14 | 3.95 | 39.0 |
| Comparative Example F | 2.09 | 40.5 |
| Comparative Example G | 2.57 | — |
| Example 15 | 1.54 | 20.0 |
| Example 16 | 0.85 | 19.7 |
| Example 17 | 0.54 | 18.0 |
| Comparative Example H | 0.78 | 16.7 |

Peak Count Measurement

Figure 5:
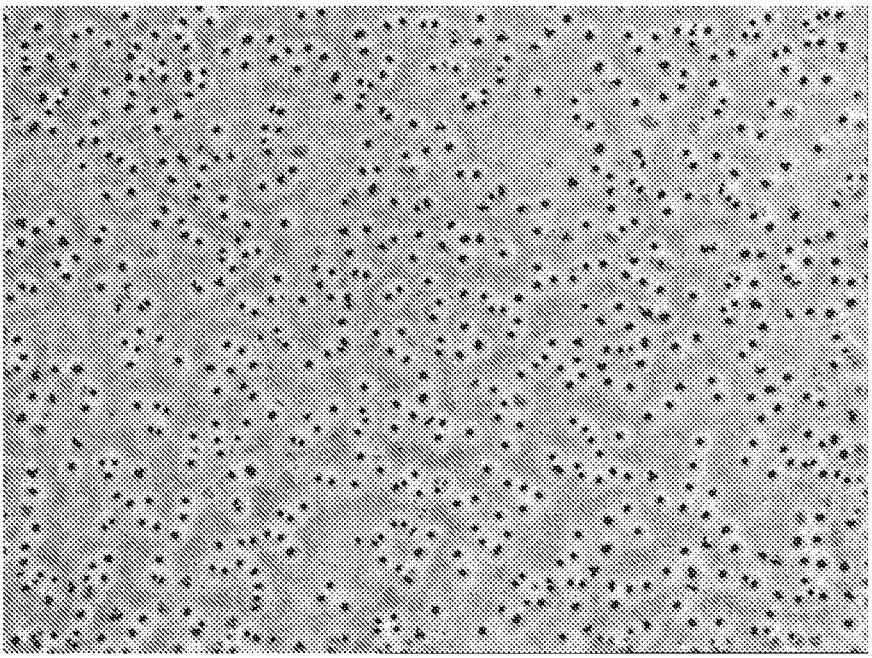
FIGS. 5 and 6 are black and white images of the coated abrasive of Example 1.
Figure 6:
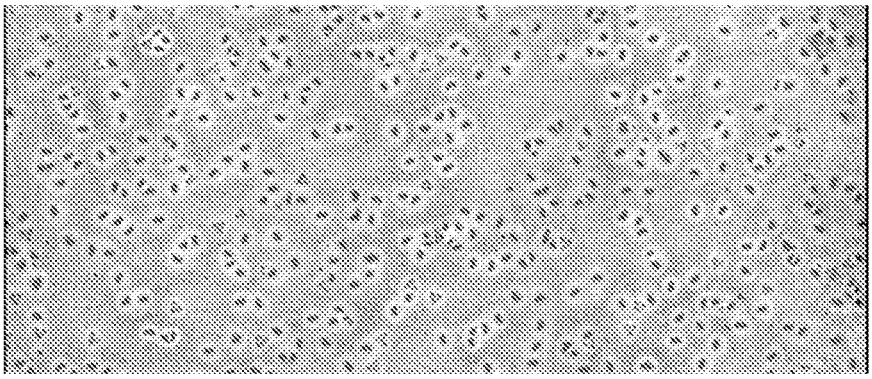

A coat-side abrasive sample with an area of approximately 4 inches (10.16 cm) by 6 inches (15.24 cm) was obtained and painted to white using spray paint obtained as "FLAT WHITE ENAMEL SPRAY PAINT" from Rust-Oleum, Vernon Hills, Ill. The painted abrasive surface was allowed to dry for at least 15 minutes. Black stamping ink (obtained as "BLACK INDIA INK" obtained from Daler Rowney, Berkshire, England) was applied to the surface of a 1 inch (2.54 cm) by 1 inch square rubber stamp (Shore A 60 durometer), the rubber stamp was then pressed down gently several times against a lint free towel to remove excess ink leaving a minimal amount of ink on the stamp (a thin layer of ink) to mitigate over-inking and blotching. The rubber stamp pad was applied over the painted abrasive sample with a force of 2.86 psi (low pressure), or 7.86 psi (medium pressure), or 17.75 psi (high pressure), whereby the tips of the upright abrasive grains were registered with ink. A digital microscope obtained as VHX-5000 from Keyence Corporation, Osaka, Japan, was used to stitch a high resolution digital image representing approximately 1000 square millimeters of region for analysis of the painted and inked abrasive sample. Binary images in black and white of the coated abrasive sample were imported into to the image analysis software of the digital microscope for analysis. Each inked peak (black dot) was identified by the image software as one peak and highlighted in red. Representative images from Example 1 with identified peaks without the red highlighting are shown in FIGS. 5 and 6. The sample analysis resulted in a peaks/area measurement of the coated abrasive sample.

Peak count measurements were performed for Examples 11, 12 and Comparative Examples E, H at three different pressures in triplicates for each. The results are reported as average peak counts per 4×6 inches (1 inch=2.54 cm) as shown in Table 4.

TABLE 4

| | Peak Count Per 4 × 6 Inches | | |
|---|---|---|---|
| Pressure Applied | Low (2.86 psi) | Medium (7.86 psi) | High (17.75 psi) |
| Example 11 - Test 1 | 9853 | 11120 | 12246 |
| Example 11 - Test 2 | 10979 | 11824 | 14217 |
| Example 11 - Test 3 | 12669 | 11824 | 13654 |
| Example 12 - Test 1 | 18299 | 28012 | 33220 |
| Example 12 - Test 2 | 17032 | 25619 | 33783 |
| Example 12 - Test 3 | 16188 | 25337 | 34346 |
| Comparative Example E - Test 1 | 41243 | 55742 | 86569 |
| Comparative Example E - Test 2 | 44481 | 62639 | 84176 |
| Comparative Example E - Test 3 | 39977 | 64751 | 89666 |
| Comparative Example H - Test 1 | 83754 | 108246 | 138933 |
| Comparative Example H - Test 2 | 84598 | 100927 | 143015 |
| Comparative Example H - Test 3 | 75167 | 115425 | 158076 |

Peak count measurements were performed for Example 11, Comparative Examples E and H as new discs and also at the end of performance test (according to the description of "PERFORMANCE TEST"). The measurements were performed at low pressure, 2.87 psi, in triplicates for each. The results are reported as average peak count per 4×6 inches as shown in Table 5.

TABLE 5

| | Peak Count Per 4 × 6 Inches | | |
|---|---|---|---|
| | As new | At the end of performance test | Peak Count Change (% Increase) |
| Example 11 | 9765 | 10183 | 4.2% |
| Comparative Example E - Test 1 | 43383 | 66678 | 53.7% |
| Comparative Example E - Test 2 | 46591 | 70026 | 50.3% |
| Comparative Example E - Test 3 | 42406 | 67794 | 59.9% |
| Comparative Example H - Test 1 | 98762 | 141447 | 43.2% |
| Comparative Example H - Test 2 | 100715 | 147864 | 46.8% |
| Comparative Example H - Test 3 | 102389 | 150514 | 47.0% |

Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. A coated abrasive article comprising:

a backing having first and second opposed major surfaces;

a first resin on at least one major surface of the backing;

abrasive particles at least partially embedded in the first resin; and a second resin on the first resin and the abrasive particles;

wherein at least a portion of the abrasive particles are configured to stand upright on an edge on the backing, and wherein no greater than 15% of the surface area of the backing is covered with abrasive particles;

wherein the ratio of the abrasive particles weight to the first resin coat weight ranges from about 2:1 to about 1:4.

2. A coated abrasive article as defined in claim 1, wherein the abrasive particles are shaped abrasive particles.

3. A coated abrasive article as defined in claim 1, wherein the abrasive particles include at least one edge and are configured to stand upright on the edge.

4. A coated abrasive article as defined in claim 1, wherein at least about 50% of the abrasive particles stand upright on the backing.

5. A coated abrasive article as defined in claim 1, wherein the make coat is continuous and no greater than 25% of the surface area of the backing is covered with abrasive particles.

6. A coated abrasive article as defined in claim 1, wherein a surface area between abrasive particles is flat and smooth.

7. A coated abrasive article as defined in claim 1, wherein the abrasive particles have an average grit size of at least about 60 to no greater than about 240.

8. A coated abrasive article as defined in claim 1, wherein the coating weight of the abrasive particles is no greater than about 6 grains/24 $in^2$, and further wherein at least 80% of the abrasive particles stand upright on the backing.

9. A coated abrasive article as defined in claim 1, wherein the coating weight of the first resin is no greater than about 7 grains/24 $in^2$.

10. A coated abrasive article as defined in claim 1, wherein the coating weight of the second resin is at least about 5 grains/24 $in^2$.

11. A coated abrasive article as defined in claim 1, wherein the abrasive particles are randomly distributed on the backing.

12. A coated abrasive article as defined in claim 1, wherein the backing is continuous, the opposed major surfaces of the backing are flat and smooth, and the backing is formed of at least one of paper, polymeric film or cloth.

13. A coated abrasive article as defined in claim 1, wherein the ratio of the abrasive particles weight to the second resin coat weight ranges from about 1:1 to about 1:25.

14. A coated abrasive article as defined in claim 1, wherein the ratio of the first resin coat weight to the second resin coat weight ranges from about 1:1 to about 1:15.

15. A coated abrasive article as defined in claim 1, wherein the upright abrasive particles have an aspect ratio of at least about 4:1.

16. A coated abrasive article as defined in claim 1, wherein the peak height of the upright abrasive particles is uniform.

17. A coated abrasive disc comprising:

a backing having a smooth continuous first major surface;

a make coat resin on the first major surface;

a plurality of shaped abrasive particles having a uniform size and shape arranged on the backing at least partially embedded in the make coat resin;

a size coat resin on the make coat resin and the abrasive particles;

wherein at least 80% of the abrasive particles stand upright on the backing and the average height of the abrasive particles standing upright on the backing is at least 3 times the thickness of the make coat resin, wherein the coating weight of the size coat resin is greater than the coating weight of the make coat resin, wherein the shaped abrasive particles have an average peak count of no greater than about 40,000 per 24 $in^2$, and wherein the abrasive particles have an average grit size of at least about 24 and no greater than about 800;

wherein the ratio of the abrasive particles weight to the first resin coat weight ranges from about 2:1 to about 1:4.

18. A method of abrading an uncoated metal workpiece during the body-in-white step of manufacturing an automotive vehicle, comprising the steps of:

securing the coated abrasive disc of claim 17 to a manually-operated tool configured to rotate the abrasive article, and manually applying the abrasive disc to the workpiece while the disc is rotating, thereby abrading the workpiece.

* * * * *